US006946624B1

(12) United States Patent
Tomassetti

(10) Patent No.: US 6,946,624 B1
(45) Date of Patent: Sep. 20, 2005

(54) HEATED TRAY FOR RAZOR

(76) Inventor: Louis D. Tomassetti, 2745 E. Atlantic Blvd., Suite 300, Pompano Beach, FL (US) 33062

( * ) Notice: Subject to any disclaimer, the term of this patent is extended or adjusted under 35 U.S.C. 154(b) by 0 days.

(21) Appl. No.: 11/004,200

(22) Filed: Dec. 3, 2004

(51) Int. Cl.[7] ..... H05B 3/14; H05B 3/06
(52) U.S. Cl. ..... 219/386; 219/521; 219/385; 34/202
(58) Field of Search ..... 219/200, 201, 219/385, 386, 520–522

(56) References Cited

U.S. PATENT DOCUMENTS 1,550,334 A * 8/1925 Baxter ..... 34/543
2,093,059 A * 9/1937 Schroder ..... 34/239
3,759,594 A * 9/1973 Cobb ..... 312/31
4,480,394 A * 11/1984 Salas ..... 34/202
4,816,648 A * 3/1989 Dusbabek ..... 219/521
5,132,518 A * 7/1992 Solacoff ..... 219/385
D433,187 S * 10/2000 Dettman ..... D28/44

* cited by examiner

*Primary Examiner*—Joseph Pelham
(74) *Attorney, Agent, or Firm*—Robert M. Downey, P.A

(57) ABSTRACT

A tray for holding a razor has a cradle formed and configured for nested engagement with the handle of the razor and the blade face of the cartridge carried on the razor head. Electric heating elements in the cradle warm the blades of the razor when the razor rests in the cradle. The cradle of the tray may further be provided with heating elements in the handle engaging portion for warming the razor handle as well as a shave product carried in the handle of a razor that has an integrated shave product dispenser.

11 Claims, 2 Drawing Sheets

HEATED TRAY FOR RAZOR

BACKGROUND OF THE INVENTION

1. Field of the Invention

The present invention relates to a heater device for shaving products and, more particularly, to a heated tray for holding a razor and heating the blades and/or a shaving product such as shaving cream or gel.

2. Discussion of the Related Art

When shaving with a razor, it is preferable to apply a foam lather to the skin in order to promote smooth passage of the blades of the razor over the skin. Today, most people use either shave cream or gel which is dispensed from a pressurized canister. Warming the skin and the shaving cream or gel prior to application provides for increased comfort and a closer shave. In particular, it is believed that the warmer temperature softens the hairs and makes them easier to cut. For many years, barber shops have used commercial grade hot lather dispensers for heating shaving cream. Typically, a barber will place a hot towel on the face of the customer and then apply the warm lather just prior to shaving. In an attempt to provide the same comfortable and close shave when shaving at home, others have proposed various devices for heating shaving cream which is dispensed from a pressurized canister. Examples of such devices are found in the U.S. Patents to Elder, U.S. Pat. No. 5,544,701 and Carlucci et al., U.S. Pat. No. 6,056,160.

In addition to warm lather, most people who shave with a razor prefer the blades of the razor to be warm when applied to the skin surface. Much like warming the lather, the warm blades provide added comfort and are believed to also enhance the performance of the razor by cutting the hairs more effectively. Warming the blades of the razor is usually done by holding the blade cartridge under hot running water.

Ideally, it is desirous to heat both the shaving cream and blades of the razor for the reasons set forth above. To do this, the present state of the art requires two separate devices or actions. Specifically, a shave cream dispensing and warming device, such as those disclosed in U.S. Pat. Nos. 5,544,701 and 6,056,160, is needed to heat the shaving cream or gel and a separate device is required for heating the blades of the razor. As noted above, most people heat the blades of the razor under hot running water, thus requiring a separate action.

The present invention provides a device which simultaneously heats a shaving product, such as shaving cream or gel, along with the blades of the razor. The heated razor tray of the present invention is particularly suited for use in conjunction with a combination razor and dispenser of the type shown in the U.S. Patent to Derin et al, U.S. Pat. No. 5,070,611. It should be noted that combined razor and dispenser devices similar to the type shown in U.S. Pat. No. 5,070,611 are contemplated for use in conjunction with the heated razor tray of the present invention.

OBJECTS AND ADVANTAGES OF THE INVENTION

Taking the foregoing into consideration, it is a primary object of the present invention to provide a razor holding tray which is structured to heat the blades of the razor and/or a shave product such as shaving cream or gel.

It is a further object of the present invention to provide a razor holding tray which is structured to heat the blades of the razor and/or a shave product carried in the handle of the razor, wherein the razor includes an integrated dispenser in the handle for dispensing the shave product therefrom.

It is still a further object of the present invention to provide a razor holding tray which provides for convenient storage of a razor and heating of the blades of the razor and/or a shave product to be used in conjunction with the razor.

It is still a further object of the present invention to provide a razor holding tray which is structured and disposed to simultaneously heat the blades of a razor and a shave product used in conjunction with the razor, thereby providing for a more comfortable and pleasurable shave.

It is still a further object of the present invention to provide a stylish and relatively inexpensive tray for holding a razor, and wherein the tray is adapted for heating the blades of the razor and/or a shaving product such as shaving cream or gel, and further wherein the tray includes a cradle which is adapted to hold a variety of razor styles and brands.

It is yet a further object of the present invention to provide a tray for holding a razor, and wherein the tray heats the handle of the razor so that the handle is warm to the touch, thereby providing for enhanced comfort when grasping the razor handle to shave.

These and other objects and advantages of the present invention are more readily apparent with reference to the following detailed description and accompanying drawings.

SUMMARY OF THE INVENTION

The present invention is directed to a tray for holding a razor and heating the blades of the razor and/or a shave product such as shaving cream or gel. The tray has a cradle that is formed and configured for nested engagement with the handle of the razor and the blade face of the cartridge carried on the razor head. Electric heating elements in the cradle warm the blades of the razor when the razor rests in the cradle. The cradle of the tray may further be provided with heating elements in the handle engaging portion for warming a shave product carried in the handle of a razor of the type which has an integrated shave product dispenser. Additionally, the handle is warmed so that it is comfortable to grasp when shaving.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
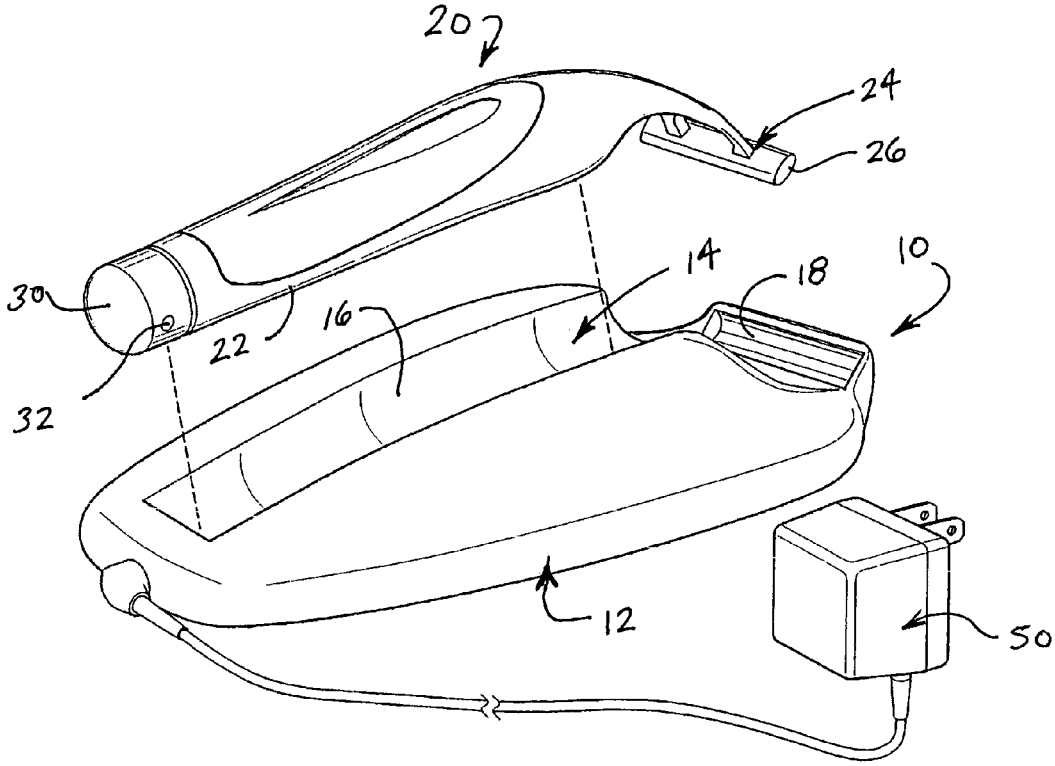
FIG. 1 is a top perspective view of the heated razor holding tray of the present invention shown with a combination razor and shave product dispenser that is separated from a cradle of the tray.

Referring to the several views of the drawings, the heated razor tray of the present invention is shown and is generally indicated as 10.

The heated tray 10 includes a molded base 12 with an integrally formed cradle 14 on a top side thereof. The cradle 14 is specifically sized and configured for nested receipt and support of a razor 20 therein. More specifically, the cradle 14 includes a handle engaging portion 16 for supporting engagement with the handle 22 of the razor 20, and a blade engaging portion 18 which is structured and disposed for nested receipt of a blade cartridge 26 carried on the head 24 of the razor 20. In a preferred embodiment, the razor 20 has an integrated dispenser for dispensing a shaving product such as shaving cream or gel. More specifically, the handle 22 of the razor 20 contains a shave product which is dispensed from nozzle 32 upon actuation of a discharge mechanism such as the end cap 30 of the handle. It should be noted that the shave product contained within the handle 22 may be either filled within a sealed hollow chamber of the handle 22 or, alternatively, the shave product may be contained within its own pressurized canister which is removably inserted within the handle 22, such as through an access door or cover on the handle.

Figure 2:
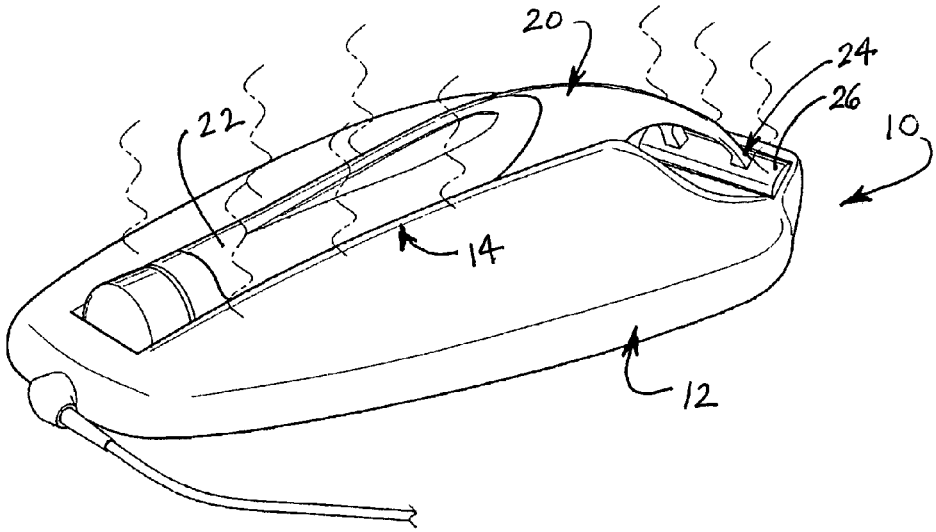
FIG. 2 is a top perspective view of the heated razor holding tray of FIG. 1 shown with the combination razor and dispenser nested within the cradle of the tray, and wherein the blades of the razor and shave product containing handle portion of the razor are being heated by heating elements in the cradle.
Figure 3:
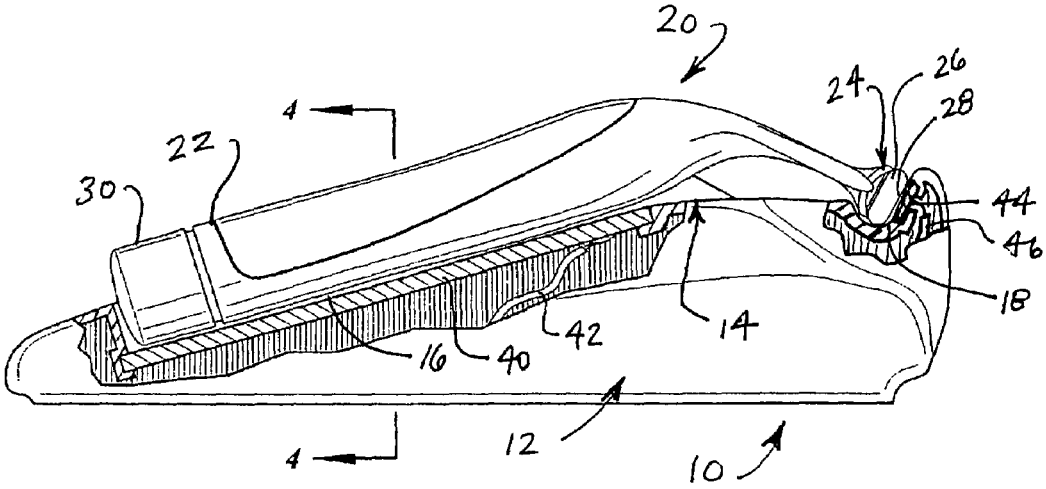
FIG. 3 is a side elevational view, in partial cross-section, showing the heated razor holding tray and the combination razor and dispenser nested within the cradle of the tray, and further illustrating heating elements within the cradle and the handle engaging portion and the blade engaging portion.
Figure 4:
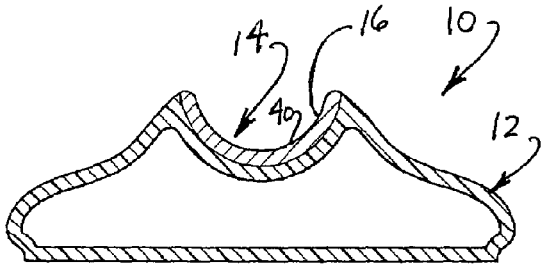
FIG. 4 is a cross sectional view taken along the plane of the line indicated as 4—4 in FIG. 3.

The handle engaging portion 16 of the cradle 14 is fitted with one or more heating elements 40. The heating elements 40 are specifically structured and disposed for heating the handle portion 22 of the razor 20 and, more particularly, for warming the shave product contained within the handle 22. Warming the handle portion 22 also provides for added comfort when grasping the razor handle. The heating elements 40 within the handle engaging portion 16 of the cradle are connected to a wire conductor 42 which leads to an electric power source, such as either a battery source contained within the base 12 or an external electric outlet. As seen in FIG. 1, an electric cord with a transformer and plug are provided for connecting the heated tray 10 to a standard electrical outlet, such as a 110 volt outlet. The transformer 50 steps the power down to 12 volts for safety purposes. The blade cartridge engaging portion 18 of the cradle 14 is further provided with a heating element 44 for heating the blades carried in the cartridge 26. Specifically, the heating element 44 is structured and disposed for heat transferring contact with the exposed blade face of the cartridge 26 so that when the razor 20 is nested within the cradle 14, as seen in FIGS. 2 and 3, the blades of the cartridge 26 are heated to a temperature within a predetermined temperature range. A wire conductor 46 connects to the heating element 44 and leads to the electric power source, as described above in connection with heating elements 40 and the wire conductor 42.

While the instant invention has been shown and described in accordance with a preferred and practical embodiment thereof, it is recognized that departures from the instant disclosure are contemplated within the spirit and scope of the present invention.

What is claimed is:

1. A tray for holding a razor having a handle and a head with a blade cartridge carrying one or more blades, said tray comprising:

a base with a top portion;

a cradle on said top portion of said base and structured and configured for nested, supported receipt of the razor therein, and said cradle including a first portion for supported engagement with the handle of the razor and a second portion for supported engagement with the blade cartridge of the razor;

a first heating element within said cradle for heating the one or more blades carried in the blade cartridge of the razor.

2. The tray as recited in claim 1 further comprising:

a second heating element in heat transferring relation to the handle of the razor when the razor is in said cradle.

3. The tray as recited in claim 2 wherein said second heating element is structured and disposed for heating a shave product contained within the handle of the razor.

4. The tray as recited in claim 1 wherein said first heating element is disposed in heat transferring relation to the one or more blades of the razor when the razor is in said cradle.

5. The tray as recited in claim 2 wherein said first heating element and said second heating element are electrically powered.

6. The tray as recited in claim 2 wherein said cradle is integrally formed with said top portion of said base.

7. A tray for holding a razor having a handle and a head with a blade cartridge carrying one or more blades, said tray comprising:

a base with a top portion;

a cradle on said top portion of said base and structured and configured for nested, supported receipt of the razor therein, and said cradle including a first portion for supported engagement with the handle of the razor and a second portion for supported engagement with the blade cartridge of the razor;

at least one heating element in said base for heating at least a portion of the razor.

8. The tray as recited in claim 7 wherein said at least one heating element is positioned and disposed for heating the one or more blades carried in the blade cartridge of the razor when the razor is in said cradle.

9. The tray as recited in claim 7 wherein said at least one heating element is positioned and disposed for heating the handle of the razor when the razor is in said cradle.

10. The tray as recited in claim 9 wherein said at least one heating element is structured and disposed for heating a shave product contained within the handle of the razor.

11. The tray as recited in claim 7 further comprising:

a plurality of said heating elements positioned and disposed for heating the one or more blades of the razor and the handle of the razor when the razor is in said cradle.

* * * * *